United States Patent [19]

Yamamoto et al.

[11] Patent Number: 4,492,740

[45] Date of Patent: Jan. 8, 1985

[54] SUPPORT FOR LITHOGRAPHIC PRINTING PLATE

[75] Inventors: Takeshi Yamamoto; Norihito Suzuki; Toru Aoki; Akio Iwaki, all of Hino, Japan

[73] Assignee: Konishiroku Photo Industry Co., Ltd., Tokyo, Japan

[21] Appl. No.: 503,186

[22] Filed: Jun. 10, 1983

[30] Foreign Application Priority Data

Jun. 18, 1982 [JP] Japan ..... 57-105724

[51] Int. Cl.[3] ..... C25D 3/04

[52] U.S. Cl. ..... 428/629; 428/615; 428/632; 428/621; 204/51; 101/454; 101/458

[58] Field of Search ..... 428/610, 624, 667, 472, 428/615, 621, 632; 204/51; 101/454, 458

[56] References Cited

U.S. PATENT DOCUMENTS 3,860,398 1/1975 Tsurumaru et al. ..... 428/629

4,296,182 10/1981 Matsubayashi et al. ..... 428/629

*Primary Examiner*—R. L. Andrews

*Attorney, Agent, or Firm*—Frishauf, Holtz, Goodman & Woodward

[57] ABSTRACT

Disclosed is a support for lithographic printing plate having an electrodeposited chromium layer on an iron material, characterized in that the surface of said electrodeposited layer has a shape in which crystalline products with angles protrude thereon, the elemental composition in the surface side portion of said electrodeposited layer consists substantially of chromium and oxygen and the ratios of atomic concentrations of chromium and oxygen at said portion are substantially even at the same depth from every point on said surface.

9 Claims, 10 Drawing Figures

SUPPORT FOR LITHOGRAPHIC PRINTING PLATE

This invention relates to a support for lithographic printing plate, more particularly to a support for lithographic printing plate having an electrodeposited chromium layer on an iron material.

BACKGROUND OF THE INVENTION

As the support for lithographic printing plate, there have been conventionally employed aluminum supports, but they have the following drawbacks, namely (1) they are expensive and (2) low in mechanical strength, and may sometimes be cut off when flexed at an acute angle in, for example, mounting on a cylinder of an offset printing machine.

On the other hand, as the support using a relatively less expensive steel material, there is disclosed in European Patent Publication No. 20021 an electrodeposited chromium layer on a metal plate characterized by an effective absence of generally planar exterior surfaces and relatively sharp protruberant angles. However, this support does not sufficiently adhere to the image portions and, when employed for a lithographic printing plate, the image line portion may partially be peeled off during printing over a long term, ink spreading may develop at the dots portion, scumming may develop at the non-image portions, or printing life is not sufficient. Also, because of the narrow tolerance in the developing method, there is practiced the so-called "hand processing" in which development is performed by rubbing the plate with a sponge impregnated with a developer without use of an automatic developing machine, whereby there is involved the problem that damages are liable to occur at the image portions. Further, separately from the treatment step for formation of an electrodeposited chromium layer, the step of treatment in a bifluoride grainer tank is required and it will take much time for this treatment step. As still other disadvantages, the total amount of electricity employed during formation of the electrodeposited chromium layer is very high which results in high production costs. Also the narrow tolerable temperature range in a bath for formation of electrodeposited chromium layer will necessarily require careful attention in temperature control.

Accordingly, an object of this invention is to provide a support for lithographic printing which is high in mechanical strength and also has sufficient performances in adhesion to a photosensitive layer, printing life and tolerance in developing methods. Other objects of this invention will become apparent from the following description.

SUMMARY OF THE INVENTION

The objects of this invention can be accomplished by a support for a lithographic printing plate having an electrodeposited chromium layer on an iron material, characterized in that the surface of said electrodeposited layer has a shape in which crystalline products with angles protrude thereon, the elemental composition in the surface side portion of said electrodeposited layer consists substantially of chromium and oxygen and the ratio of the atomic concentrations of chromium and oxygen in said portion is substantially even at the same depth from every point of said surface.

The support for a lithographic printing plate according to this invention will be described below in detail with reference to the accompanying drawings:

BRIEF DESCRIPTION OF THE DRAWINGS

(FIG. 6: 20,000 magnification, orthographic projection.

DETAILED DESCRIPTION OF THE DRAWINGS

Figure 1:
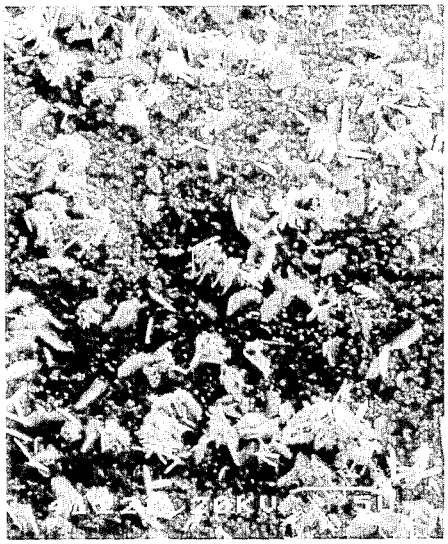
FIG. 1 (photograph) is a scanning type electron microscope photograph of a support surface having a shape in which plate crystals protrude (2,400 magnification, slanted angle of 30°)
Figure 2:
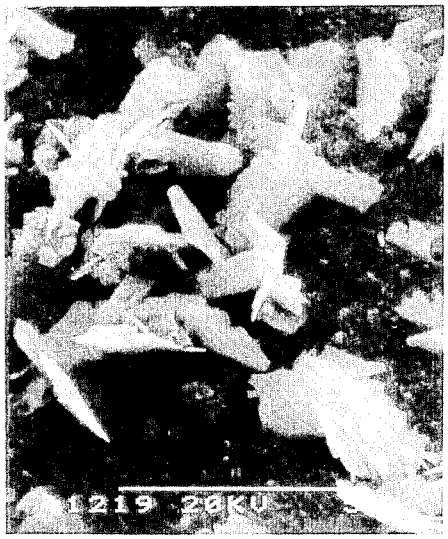
FIG. 2 (photograph) is a scanning type electron microscope photograph of 8,400 magnification of the same sample as in FIG. 1 (slanted angle of 30°)
Figure 3:
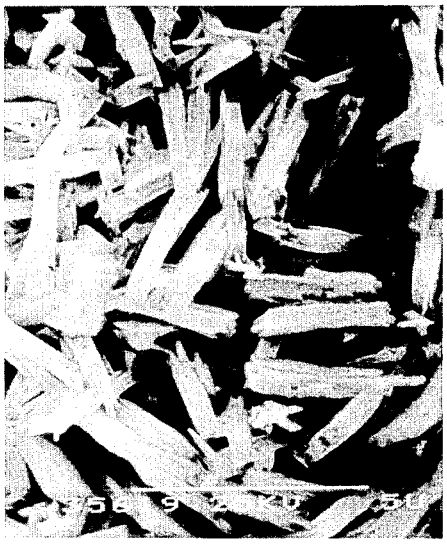
FIG. 3 (photograph) is a scanning type electron microscope photograph of a support surface having a shape in which plate crystals protrude (8,000 magnification, orthographic projection)
Figure 4:
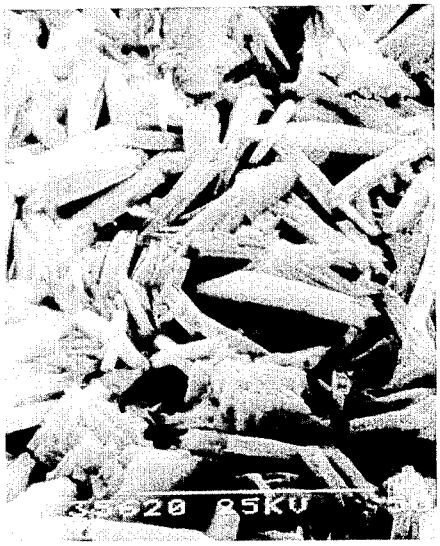
FIG. 4 (photograph) is a scanning type electron microscope photograph at a slanted angle of 30° of the same sample as in FIG. 3 (8,000 magnification)
Figure 5:
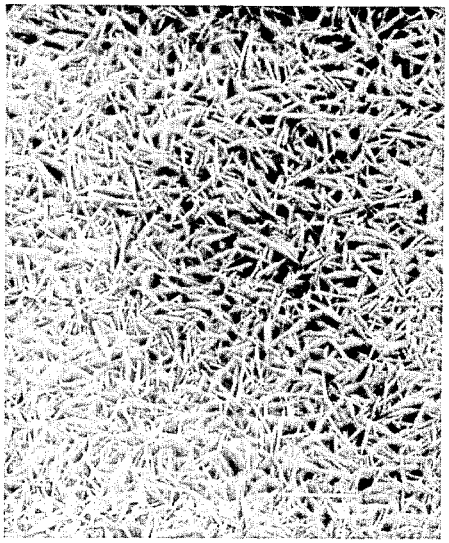
FIG. 5 (photograph) is a scanning type electron microscope photograph of a support surface having a shape in which plate crystals protrude (1,600 magnification, slanted angle of 30°)

The iron material to be used in this invention is inclusive of pure iron and also alloys of iron with other elements. As other elements forming alloys with iron, there may be included carbon, manganese, nickel, and others. Typical examples of the alloys include carbon steels (alloys of carbon (0.04 to 1.7%) and iron), cast irons with higher amounts of carbon than carbon steels, and further special steels (e.g. manganese steel, nickel steel, chromium steel, nickel-chromium steel) having added other elements (e.g. manganese, nickel, chromium, cobalt, tungsten, molybdenum), etc. The above carbon steels may include super-soft steels (0.25% or less carbon), soft steels (0.25 to 0.5% carbon), hard steels (0.5 to 1.0% carbon) and super-hard steels (1.0% or more carbon).

The preferred surface shape in which crystalline products with angles protrude on the electrodeposited layer in this invention includes a shape in which plate or hexahedral (for example, cubic) crystals, or an agglomerated product of these crystals or a mixture of said crystals and/or said agglomerated product protrude. The plate crystals are preferably polygonal (primarily hexagonal) plates, and the polygonal shape may have sizes of faces preferably of 0.5 to 5 $\mu$m and thicknesses preferably of 0.01 to 0.8 $\mu$m. As the hexahedral crystals, cubic crystals, especially those having side lengths of 0.1 to 2 $\mu$m are preferred.

The aforementioned "crystalline products with angles" mean angular crystalline products, as different from spherical or ellipsoidal crystalline products or coalescent products of these, and are inclusive of those in which the angles possessed by crystalline products appeared in the protuberant portions in crystals in the surface shape of the electrodeposited chromium layer in electron-microscope photographs with magnifications of 3,000 to 30,000, are equal to or smaller than the angles, namely face angles or radius of curvatures of edges, of the crystalline products as shown in FIG. 1 through FIG. 7.

The portion of the protuberant crystalline products may have a projected area percentage preferably of 20% or more. The projected area percentage herein mentioned refers to that obtained by projection in the direction perpendicular to the support face having the electrodeposited layer of this invention, namely orthographic projection, and said area percentage is measurable by means of microscopic photography, etc.

In the support of this invention, the constitutional ratio of the respective atoms such as oxygen, chromium and iron may be varied within the region of from the surface of the electrodeposited chromium layer toward the substrate (iron material); such that oxygen atoms, without being increased, or after being slightly increased, soon begin to be decreased; chromium atoms, after being increased, are gradually decreased closer to the substrate; and the atoms constituting the substrate such as iron, etc. begin to exist at a certain depth from the surface of the electrodeposited chromium layer, being increased as the depth increases.

In this invention, the electrodeposited chromium layer is constituted in the substrate side substantially of the atoms constituting the substrate and chromium atoms, and the constitutional ratios are varied continuously such that the ratio of the atoms constituting the substrate becomes greater and the ratio of chromium becomes smaller closer to said substrate. In this invention, the electrodeposited chromium layer refers to a region from the support surface to a position at which the number of the atoms constituting the substrate and the number of chromium atoms are identical, and its thickness may preferably be 0.01 to 10 μm, particularly preferably 0.01 to 4 μm. The thickness can be determined by fluorescent X-ray analysis as an average value by the quantitative determination with reference to the calibration curve previously prepared from the standard chromium plated layers with known thicknesses. Here, "the electrodeposited chromium layer is constituted in the substrate side substantially of the atoms constituting the substrate and chromium atoms" means that the sum of the respective atomic concentrations of the atoms constituting the substrate and chromium atoms is 60% or more.

In this invention, "the surface side portion of the electrodeposited chromium layer" refers to the portion of from the surface of said electrodeposited layer to the position where the atomic concentration of the atoms constituting the substrate exceeds 20%, and "the elemental composition on the surface side portion consists substantially of chromium and oxygen" means that the sum of the respective atomic concentrations of chromium atoms and oxygen atoms is 50% or more, thus meaning that other components than chromium atoms and oxygen atoms, for example, carbon atoms, chlorine atoms, sulfur atoms, calcium atoms, nitrogen atoms, fluorine atoms, etc., may be permitted to be contained within the range which does not impair the effect of this invention.

The above atomic concentrations can be determined by the surface analytical means such as photoelectric spectroscopy (e.g. X-ray photoelectric spectroscopy), and Auger electron spectroscopy.

The profile of the elements in the direction of the depth of the electrodeposited chromium layer in the support in this invention may be determined by Auger electron spectroscopy, and the atomic concentrations at various depths at various portions of the electrodeposited chromium layer can be determined by local analyses by means of the Scanning Auger Microprobe (e.g., PHI. Model 595, 600 produced by Perkin Elmer Co).

The elemental composition in the surface side portion of the electrodeposited chromium layer in the support of this invention may preferably be such that, in variations of the atomic concentrations of chromium and oxygen in the depth direction along the normal line on the electrodeposited chromium layer surface, the atomic concentration Ya % of chromium at the depth of Xnm from said surface is within the range satisfying the conditions as represented by the formula (I) $Ya \leqq -0.464X^2+7.82X+70$ (where $0 \leqq X \leqq 6$) and the formula (II) $Ya \geqq -0.0398X^2+1.99X+15$ (where $0 \leqq X \leqq 25$), and the atomic concentration Yb % of oxygen within the range satisfying the conditions as represented by the formula (III) $Yb < 0.0884X^2-4.46X+80$ (where $0 \leqq X \leqq 25$) and the formula (IV) $Yb \geqq 0.5X^2-8.1X+20$ (where $0 \leqq X \leqq 3$), and further the sum of Ya and Yb may preferably be within the range satisfying the formula (V) $Ya+Yb \geqq -0.0187X^2+1.23X+50$ (where $0 \leqq X \leqq 25$). And, it is further preferred that at $Xnm < 1.0$ nm, $Yb > Ya$, and the depth Xonm when $Ya = Yb$ is within the range $1.0 \leqq Xo \leqq 14.0$, particularly preferably $1.5 \leqq Xo \leqq 8$.

The above depths from the surface were determined by transformation based on the depth direction analyses as described below.

As the measuring conditions for the depth direction analyses by means of the aforesaid PHI Model 595, argon ion was used as the ion gun and etching was effected at a speed of 20 Å/min. with thallium oxide ($Ta_2O_5$) as the standard (determined from the time for etching of $Ta_2O_5$ with known film thicknesses), and further in calculation of the elemental composition, the peak intensities of the Auger spectrum (differential form) employed concern the peak at 529 eV for chromium and the peak at 503 eV for oxygen, the relative sensitivities of chromium and oxygen employed being the values as disclosed in L. E. Davis, P. W. Palberg, G. E. Riach, R. E. Weber, N. C. MacDonald "Handbook of Auger Electron Spectroscopy sec. ed." (Physical Electronics Division Perkin-Elmer Corp., 1976). Also, the diameter of the primary electron beam was narrowed to 500 Å to 1 μm to analyze the crystalline portion and the non-crystalline portion separately for micro-regional analysis. In carrying out measurement of the crystalline portion, the primary electron beam is irradiated accurately onto the central portion of the crystalline portion so that the brim of the crystalline portion may not be included within the irradiation region of said beam. For example, with respect to the plate crystal portion, irradiation is effected at the center of said flat plate portion. On the other hand, the ion beam for etching is irradiated at an incident angle of 45° to 90° relative to the crystalline portion plane and the non-crystalline portion plane. During this operation, incidence of said ion beam onto the spot to be analyzed should not be interfered by other surrounding crystals not to be analyzed. Further, the primary electron gun and the electron energy analyzer may be desirably arranged around the same directional axis (co-axial type) for the present measurement.

The depth Xnm from the surface as defined above is obtained by transforming the etching time from the aforesaid etching speed into depth, being calculated on the basis that all the compositions are chromium oxide ($Cr_2O_3$). Further, the aforesaid elemental composition shows the ratio of the number of atoms per unit area.

In this invention, the elemental composition in the surface side portion of the electrodeposited chromium layer consists substantially of chromium and oxygen and the respective elemental compositions of chromium and oxygen at said portion are substantially even at the same depth from said surface and at respective portions on said surface. This means that the respective elemental compositions of chromium and oxygen, anywhere irrespective of whether at the portion of the protuberant crystalline products on the surface or at any other portion, are substantially the same. The wording "substantially the same" means that, in the element profile in the depth direction at each portion, the value of Xo is within the range of error of ±80%. The above error is calculated by dividing the difference between the two values by the greater value of the two values and multiplying the resultant value by 100.

The surface side portion of the electrodeposited chromium layer of this invention may be judged by the elemental analysis in the depth direction to consist substantially of chromium oxides (the chromium oxides include also hydrates) and metallic chromium, with the ratio of metallic chromium being increased as the depth increases. As chromium oxides, there may be included oxides of divalent, trivalent or hexavalent chromium, primarily trivalent chromium oxides.

Figure 6:
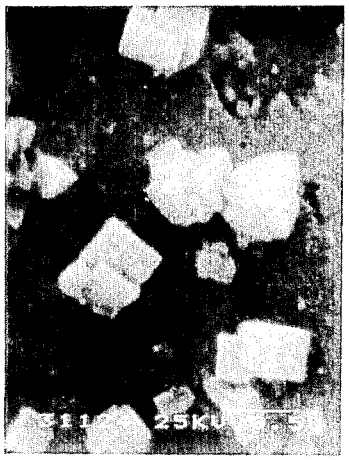
FIG. 6 (photograph) and FIG. 7 (photograph) are scanning type electron microscope photographs of the support surfaces having a shape in which cubic crystals and agglomerated masses thereof protrude
Figure 7:
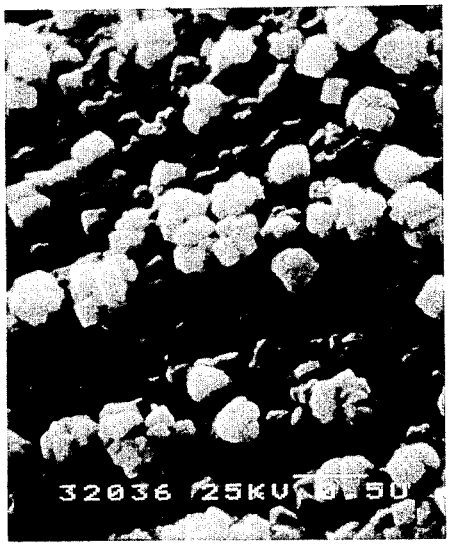
FIG. 7: 24,000 magnification, slanted angle of 30°)

On the surface of the electrodeposited chromium layer, there exist the portions having shapes of crystalline products with angles. When the crystalline products or agglomerated product thereof forming such shapes is compared with the spheroidal particles of the prior art, there is also a difference in that the former has crystalline products in the form relatively separated from each other, while the latter particles are coalescently agglomerated. FIG. 1 through FIG. 7 show the photographs of the electro-deposited chromium layer surfaces of the typical supports for the lithographic printing plate of this invention taken by use of a scanning type electron microscope, and FIG. 1 through FIG. 5 show shapes of various plate crystals, while FIG. 6 and FIG. 7 show shapes of cubic crystals and agglomerated products of cubic crystals.

Next, there are shown typical examples of the preparation methods for obtaining the supports of this invention having such electrodeposited chromium layers as described above.

As the step for pre-treatment of the surface of an iron material such an iron plate, the Electrolyte 1 as shown in Table 1 and an iron plate as the counter-cathode are employed, and electrolytic treatment is carried out under the Electrolysis Conditions 1 as shown in Table 2.

TABLE 1

| Electrolyte 1 | |
|---|---|
| Anhydrous chromic acid | 80–200 g |
| Nitric acid (64%) | 0.5–1 ml |

TABLE 1-continued

| Electrolyte 1 |
|---|
| make up to one liter with water |

TABLE 2

| Electrolysis Conditions 1 | |
|---|---|
| Direct current voltage | 4–10 V |
| Current density | 2–10 A/dm$^2$ |
| Liquid temperature | 10° C.–40° C. |
| Anode | Iron material |
| Area ratio of cathode to anode | 1:1 |
| Treatment time | 30 sec.–5 min. |

The thus pre-treated iron was washed with water by spraying a shower thereon and then transferred to the main treatment step.

This main treatment step is a step for forming the electrodeposited chromium layer of this invention, in which Electrolyte 2 as shown in Table 3 is cooled or heated by a coil tube for temperature control to adjust the liquid temperature, and electrolytic treatment is conducted under the Electrolysis Conditions 2 as shown in Table 4.

TABLE 3

| Electrolyte 2 | |
|---|---|
| Anhydrous chromic acid ($Cr_2O_3$) | 80–200 g |
| Barium compound | 1–10 g |
| Fluoride, e.g. hydrogen fluoride (HF) | 0–20 g |
| Nitric acid | 0–10 g |
| Acetic acid | 0–1 g |
| make up to one liter with water | |

TABLE 4

| Electrolysis Conditions 2 | |
|---|---|
| Direct current voltage | 5–15 V |
| Current density | 5–50 A/dm$^2$ |
| Liquid temperature | 30–60° C. |
| Cathode | Iron material |
| Anode | Lead electrode |
| Area ratio of cathode to anode | 1:1 to 1:1.5 |
| Treatment time | 2–6 min. |

After this treatment, it is also possible to apply an appropriate post-treatment. For example, the supports can be treated at a suitable temperature by washing with or dipping in an aqueous hydrophilic resin solution such as aqueous carboxymethylcellulose solution, aqueous polyvinyl alcohol solution, polymethacylic acid solution, polyacrylic acid solution, aqueous sodium alginate solution, etc.; aqueous solution of acids such as phosphoric acid, aluminum sulfate, etc., alkalis such as caustic soda, etc., or fluorides such as potassium fluorozirconate, potassium fluorotitanate, etc; further aqueous solutions of salts containing the group VB, VIB metals of Periodic Table such as ammonium molybdenate, phosphotungstic acid, sodium phosphotungstate, sodium phosphomolybdenate, silicotungstic acid, etc.

The support of this invention, on account of the surface shaped formed by the electrodeposited chromium layer, is excellent in adhesion to layers comprising polymeric compounds having lipophilic surfaces such as photosensitive layers provided thereon, and when employed for the photosensitive lithographic printing plate, the plate has good printing life. Also, due to wide tolerance in developing methods, the loss of image portions is very small even by the "hand processing" method which requires excessive friction.

Further, due to its surface shape, it is good in water retentivity to afford easy management of water.

Also, as contrasted with the supports of the prior art such as aluminum or chromium-plated iron materials, the support of this invention gives the advantages of high production efficiency and low production cost because of the simple method of production.

Photosensitive lithographic printing plates can be produced by coating photosensitive compositions, for example, with the use of organic solvents, on the support of this invention.

Photosensitive compositions contain as essential components photosensitive substances. As the photosensitive substance, there may be employed a substance which can be exposed to light to vary in solubility of the photosensitive composition layer relative to the developer, to vary in adhesive force between molecules, or to vary in affinity of the photosensitive composition layer for water and oil.

In the following, typical examples of such substances are to be described. First, there may be mentioned positive-type photosensitive substances of the quinoneazide type such as o-naphthoquinonediazide compounds well known in the art.

o-Quinonediazide compounds are compounds having at least one o-quinonediazide group, preferably o-benzoquinodiazide group or o-naphthoquinonediazide group, and are inclusive of compounds of various known structures, as described in detail in J. Kosar "Light-Sensitive Systems" (published by John Wiley & Sons, Inc., 1965), pp. 339–353. In particular, esters of various hydroxyl compounds with o-naphthoquinonediazide sulfonic acid are preferred. As preferable hydroxyl compounds, there may be included condensed resins of phenols with carbonyl containing compounds, especially resins obtained by condensation in the presence of an acidic catalyst. Said phenols may include phenol, resorcinol cresol, pyrogallol and the like, while said carbonyl containing compounds may include aldehydes, such as formaldehyde, benzaldehyde, and ketones such as acetone.

Particularly, phenol-formaldehyde resins, cresol-formaldehyde resins, pyrogallol-acetone resins and resorcinol-benzaldehyde resins are preferred.

Typical examples of o-quinonediazide compounds may include esters of benzoquinone-(1,2)-diazidesulfonyl chloride or naphthoquinone-(1,2)-diazidesulfonyl chloride with phenol-formaldehyde resins; sulfonic acid esters of naphthoquinone-(1,2)-diazidesulfonyl chloride and pyrogallolactone resins as disclosed in U.S. Pat. No. 3,635,709; condensed products of naphthoquinone-(1,2)-diazide-(2)-5-sulfonyl chloride and resorcinol-benzaldehyde resins as disclosed in Japanese Unexamined Patent Publication No. 1044/1981; ester compounds of naphthoquinone-(1,2)-diazide-(2)-5-sulfonyl chloride and resorcinol-pyrogallol-acetone co-condensed products as disclosed in Japanese Unexamined Patent Publication No. 76346/1980; as other useful o-quinonediazide compounds, those obtained by the esterification reaction of o-naphthoquinonediazidesulfonyl chloride with polyesters having terminal hydroxyl groups as disclosed in Japanese Unexamined Patent Publication No. 117503/1975 and those obtained by the esterification reaction of o-naphthoquinonediazidesulfonyl chloride with p-hydroxylstyrene homopolymers or copolymers of p-hydroxylstyrene with other copolymerizable monomers; and so on.

These o-quinonediazide compounds may be contained preferably in amounts of 5 to 80% by weight, particularly pareferably 10 to 50% by weight, based on the total solids of the photosensitive composition.

Such a quinonediazide type positive-type photosensitive metal preferably may be used in combination with an alkali-soluble resin as binder. As alkali-soluble resins are preferably those obtained by reacting phenols with ketones or aldehydes in the presence of an acidic catalyst. Said phenols may include, for example, phenol, cresol, p-substituted phenols and the like. Said aldehydes may include, for example, acetaldehyde, formaldehyde and the like, preferably formaldehyde. As ketones, acetone is preferred.

As preferable alkali-soluble resins, there may be included, for example, phenol-formaldehyde resins, cresol-formaldehyde resins, phenol-cresol-formaldehyde co-condensed resins as disclosed in Japanese Unexamined Patent Publication No. 57841/1980, co-condensed resins of p-substituted phenol, phenol or cresol and formaldehyde as disclosed in Japanese Unexamined Patent Publication No. 127553/1980, condensed products of polyhydric phenols with benzaldehyde such as resorcinol-benzaldehyde resins, pyrogallol-benzaldehyde resins, etc., co-codensed products of polyhydric phenols with acetone such as pyrogallol resorcinol-acetone resin, etc., xylenol-formaldehyde resins and others. These alkali-soluble resins may be contained preferably in amounts of 30 to 90% by weight, particularly 50 to 85% by weight, based on the total solids in the photosensitive composition.

As other photosensitive substances, there may also be employed diazo resins, typically condensed products of aromatic diazonium salts and formaldehyde. Particularly preferred, are salts of condensed products of p-diazodiphenylamine and formaldehyde or acetaldehyde, diàzo resin inorganic salts which are the reaction products of hexafluorophosphates, tetrafluoroborates, perchlorates or periodates with said condensed products, diazo resin organic salts of said condensed products with sulfonic acids as disclosed in U.S. Pat. No. 3,300,309, and the like. Further, diazo resins may be used preferably together with binders. As such binders, there may be employed various polymeric compounds, preferably copolymers of monomers having aromatic hydroxyl groups such as N-(4-hydroxyphenyl)acrylamide, N-(4-hydroxyphenyl)methacrylamide, o-, m-, or p-hydroxystyrene, o-, m- or p-hydroxyphenyl methacrylate, etc. with other monomers as disclosed in Japanese Unexamined Patent Publication No. 98613/1979; polymers containing hydroxyethyl acrylate units or hydroxyethyl methacrylate units as primary recurring units as disclosed in U.S. Pat. No. 4,123,276; natural resins such as shellac, rosin, etc,; polyvinyl alcohol; polyamide resins as disclosed in U.S. Pat. No. 3,751,257; linear polyurethane resins as disclosed in U.S. Pat. No. 3,660,097; phthalated resins of polyvinyl alcohol; epoxy resins condensed from bisphenol A and epichlorohydrin; celluloses such as cellulose acetate, cellulose acetate phthalate and the like.

As still other photosensitive substances, there may suitably by employed those containing as principal components photosensitive polymers such as polyesters, polyamides or polycarbonates including $$-CH=CH-\underset{\underset{O}{\|}}{C}-$$

as photosensitive groups in the polymeric main chain or side chain. For example, there may be included photosensitive polyesters obtained by condensation of phenylenediethyl acrylate, hydrogenated bisphenol A and triethyleneglycol as disclosed in Japanese Unexamined Patent Publication No. 40415/1980; photosensitive polyester compounds derived from (2-propenylidene)-malonic acid compounds such as cinnamilidene malonic acid and bifunctional glycols as disclosed in U.S. Pat. No. 2,956,878; and so on.

Further, as still other photosensitive substances, there may also be used aromatic azide compounds having azide groups directly or through a carbonyl groups or a sulfonyl group bonded to aromatic rings. For example, there may be included polyazidestyrene, polyvinyl-p-azidebenzoate, polyvinyl-p-azidebenzal as disclosed in U.S. Pat. No. 3,096,311; the reaction products of azidearylsulfanyl chloride and unsaturated hydrocarbon type polymers as disclosed in Japanese Patent Publication No. 9613/1970; and polymers having sulfonylazide or carbonylazide as disclosed in Japanese Patent Publication Nos. 21067/1968, 229/1969, 22954/1960 and 24915/1970.

Further, as still another photosensitive substance, there may also be employed a photopolymerizable composition comprising an addition polymerizable unsaturated compound. The support of this invention can be used as a support of a lithographic printing plate obtained by an electrophotographic process.

Representative methods forming a printing plate by electrophotography are shown below:

(1) A method comprising; forming a toner-image by electrophotography on a lithographic printing plate material comprising a support of this invention having a photoconductive layer thereon, and making hydrophilic the surface of the photoconductive layer at a non-image portion.

(2) A method comprising; forming a toner-image by electrophotography on a lithographic printing plate material comprising a support of this invention having a photoconductive layer thereon, and removing the photoconductive layer at a non-image portion.

(3) A method comprising; transferring a toner-image formed by electrophotography onto a lithographic printing plate material comprising a support of this invention having a polymeric layer thereon, fixing the toner-image transferred by heating, and removing the polymeric layer at a non-image portion.

The lithographic printing plate obtained by the method (1) comprises a support of this invention having a photoconductive layer on the total surface thereof and having a toner-image only at an image portion on said photoconductive layer.

The lithographic printing plate obtained by the method (2) comprises a support of this invention having a photoconductive layer only at an image portion thereon and having a toner-image on the entire surface of said photoconductive layer.

The lithographic printing plate obtained by the method (3) comprises a support of this invention having a polymeric layer only at an image portion thereon and having a toner-image on the total surface of said polymeric layer.

The photoconductive layer mentioned above comprises a photoconductive material. The photoconductive material may be, for example, an inorganic or organic photoconductive material or a photoconductive organic pigment. At least one of them is used. The inorganic photoconductive material may be, for example, selenium- or zinc oxide-based material, cadmium sulfide or the like which are known for electrophotography. The organic photoconductive material may be, e.g. polyvinylcarbazole, oxazoles or pyrylium salt. Examples of the photoconductive organic pigments are phthalocyanine, quinacridone pigments or the like.

It is possible to use in said photoconductive layer such sensitizing dyes or chemical sensitizing agents as described in Japanese Patent Publication No. 7333/1965 and Japanese Unexamined Patent Publication No. 134632/1979. The aforesaid photoconductive material (and sensitizing agent) can be dissolved or suspended in a solution containing at least one natural or synthetic high-molecular substance (e.g. styrene, silicone or phenol resin or the like), coated onto a support and dried according to a known procedure. The photoconductive layer may also contain various additives, for example, surface active agents for improving the coating property, and plasticizers for imparting softness and wear resistance to the coated layer. It is also possible to form an intermediate layer (e.g. of polyvinyl alcohol, ethyl cellulose, polyacrylic acid or the like) between a support and the photoconductive layer so as to improve the electrophotographic characteristics.

The thickness of the photoconductive layer after drying is preferably $1\mu$ to $50\mu$, and more preferably $1\mu$ to $15\mu$.

The thus obtained printing plate material is then electrostatically charged by usual electrophotographic methods, and exposed to the xenon, halogen, fluorescent, or tungsten-filament lamp or to a laser beam such as semiconductor, $Ar^+$ or He-Ne laser, thereby to form an electrostatic latent image. The formed latent image is then toner-developed.

In the above-mentioned method (1) or (2), wherein the support of this invention is used as a support for said photoconductive layer, the toner-image is, after toner-developing, fixed with heat by use of a heat plate, heat roller, heat rays or the like. Then, in the non-imaged area (where there is no toner attached), the photoconductive layer is made hydrophilic in the method (1) or removed by use of an appropriate solvent in the method (2) to give a lithographic printing plate.

In the above mentioned method (3), it is not essential to use a support of this invention as a support of a photoconductive layer. After toner-developing, the toner-image is transferred onto a polymeric layer which is on a support of this invention and the transferred toner-image is fixed with heat. Then the polymeric layer in the non-imaged area is removed to give a lithographic printing plate.

For the toner development, it is possible to use a dry process in which both toner and carrier are solid, a wet process in which the toner or the carrier is liquid, or an aerosol process in which a gas flow is used as the carrier regardless of whether the toner is solid or liquid.

It is preferable that the toner is hydrophobic and has an ink accepting property. The toner may have positive or negative polarity, With the lithographic printing plate material mentioned above, it is possible to obtain both positive-positive and negative-negative printing plates with only one toner developer by use of the charging property to both positive and negative polarities.

The support of this invention can be used as a support of a lithographic printing plate obtained by the use of a silver halide emulsion.

Representative methods using a silver halide emulsion are shown below:

(1) A method comprising; exposing a lithographic printing plate material comprising a support of this invention having a silver halide emulsion layer thereon and having a tanning developing agent such as polyhydroxybenzene in said emulsion layer or a separate layer, and tanning developing agent with an alkaline solution. In the printing plate obtained by this method, the developed area has an ink accepting property. It is preferable that the layer in a non-developed area is removed with warm water and the like. This method is described in detail, for example, in U.S. Pat. Nos. 3,146,104 and (T) 881,005, and Japanese Patent Publication No. 23166/1970.

(2) A method comprising; exposing a silver halide emulsion layer, developing the exposed silver halide emulsion in the presence of a silver halide solvent, transferring the silver complex produced on said development into a layer (preferably a separate layer from the emulsion layer) containing physical development nuclei, and forming an image portion by physical development.

In this method, a support of this invention is used as a support of a physical development nuclei-containing layer. This silver halide emulsion layer may be carried on the support having the physical development nuclei layer or a separate support. The silver complex may be produced in an exposed area or non-exposed area. A method for producing a silver coupler in a non-exposed area is described in detail in, for example, U.S. Pat. Nos. 3,083,097 and 3,161,508, Japanese Patent Publication Nos. 26526/1971, 16725/1973, and 30562/1973.

The method for producing a silver complex in an exposed area comprises exposing an element comprising a support carrying silver halide particles, non-photosensitive metal salt particles being more soluble than the silver halide particles and the surface portion thereof being made less soluble and physical development nuclei, and treating the exposed element with a treating solution containing a material capable of solving said metal salt particles, and is described in detail, for example, in Japanese Unexamined Patent Publication Nos. 48554/1979, 165140/1981, 44138/1982 and 44153/1982.

(3) A method being so-called etching bleach process described in detail in, for example, U.S. Pat. No. 3,385,701. Belgian Pat. No. 717466, British Pat. No. 1235911, and Japanese Patent Publication No. 27242/1969.

The support of this invention can be used as a support of a lithographic printing plate requiring no damping water. The lithographic printing plate material giving the printing plate comprises a support of this invention having a ink-repelling layer thereon.

In case the ink-repelling layer becomes reactive on light exposure, it does not require any other layers other than the ink-repelling layer. In case the ink-repelling layer does not become reactive on light exposure, it requires a lightsensitive layer other than the ink-repelling layer.

Representative printing plate materials are shown below:

(1) A lithographic printing plate material comprising a support of this invention having as an essential layer a ink-repelling layer being reactive on light exposure thereon.

(2) A lithographic printing plate material comprising a support of this invention having as essential layers a layer containing a photosensitive substance and an ink-repelling layer in this order.

A usable photosensitive substance may be any substance known for such a printing plate, e.g., a diazonium salt such as formaldehyde condensate of p-diazodiphenylamine salt, an o-naphthoquinonediazide compound, a photopolymerizable photosensitive material having an ethylenically unsaturated group, an azide compound, an $\alpha,\beta$-unsaturated ketone compound, an $\alpha$-phenylmaleimide compound and the like, a compound obtained by reacting the above-listed photosensitive materials and silicone compounds, or the like.

The aforesaid ink-repelling layer may be formed by use of diorganopolysiloxane compounds such as dimethylpolysiloxane and diphenylpolysiloxane, copolymers of these compounds, poly-fluorinated compounds, or the like.

The ink-repelling layer which becomes reactive on light exposure may be formed by use of organopolysiloxane, poly-fluorinated compound, or the like each having a photosensitive group.

The lithographic printing plate material described above is exposed through a positive or negative film to an active light beam emitted from a mercury vapor, a carbon arc, a metal halide lamp or the like. The exposed printing plate material is then developed with a developing solution suitable for the photosensitive substance to complete the printing plate. The thus obtained printing plate is then used for printing with a printing press which is not equipped with a damping water feeder.

The support of this invention can be used as a support of a duplicate plate obtained by such a method that comprises printing on a support of a duplicate plate from an original printing plate by use of a material such as an ink which can be hardened and becomes ink-receptive after hardening the material on the support of the duplicate plate.

The method is described in detail in Japanese Unexamined Patent Publication Nos. 46973/1980, 100005/1978, etc. The present invention will be illustrated in further detail by referring to the following Examples, by which, however, the embodiments of the present invention are not limited.

EXAMPLE 1

On a carbon steel plate with a thickness of 0.15 um, as the pre-treatment step, electrolytic treatment was applied, using the Electrolyte I as shown in Table 5 and an iron plate as the counter-electrode, under the Electrolysis Conditions I as shown in Table 6.

TABLE 5

| Electrolyte I | |
|---|---|
| Anhydrous chromic acid | 100 g |
| Nitric acid (64%) | 0.8 lit. |
| Water | 1000 lit. |

TABLE 6

| Electrolysis Conditions I | |
|---|---|
| Current density | 4 A/dm$^2$ |
| Liquid temperature | 25° C. |

TABLE 6-continued

| Electrolysis Conditions I | |
|---|---|
| Cathode | Iron plate (1.2 $m^2$) |
| Anode | Iron plate for support (1.2 $m^2$) |
| Treatment time | 1 min. |

The thus pre-treated iron was washed with water by spraying a shower thereon and then transferred to the main treatment step. The Electrolyte II and the Electrolysis Conditions II in the main treatment step are shown in Table 7 and Table 8.

TABLE 7

| Electrolyte II | |
|---|---|
| Anhydrous chromic acid | 430 kg |
| Barium nitrate | 3.8 kg |
| Nitric acid (64%) | 1.2 lit. |
| Ammonium hydrofluoride | 5 kg |
| Acetic acid | 0.2 kg |
| Barium fluoride | 0.1 kg |
| Water | 1000 lit. |

TABLE 8

| Electolysis Conditions II | |
|---|---|
| Current density | 20 A/$dm^2$ |
| liquid temperature | 30° C. |
| Cathode | Iron plate for support (1.2 $m^2$) |
| Anode | Lead plate (1.6 $m^2$) |
| Treatment time | 3 min. |

The carbon steel plate having thus finished the main treatment step was subsequently subjected to shower washing with water and transferred to the post-treatment step. In the post-treatment step, the plate was dipped first in an aqueous 5% caustic soda solution at 40° C. for one minute, followed by shower washing with water, then dipped in an aqueous carboxymethylcellulose sodium salt solution .(0.07% by weight) at room temperature for one minute, followed by shower washing with water. After completion of the post-treatment step, the product was dried on cool air.

Figure 8:
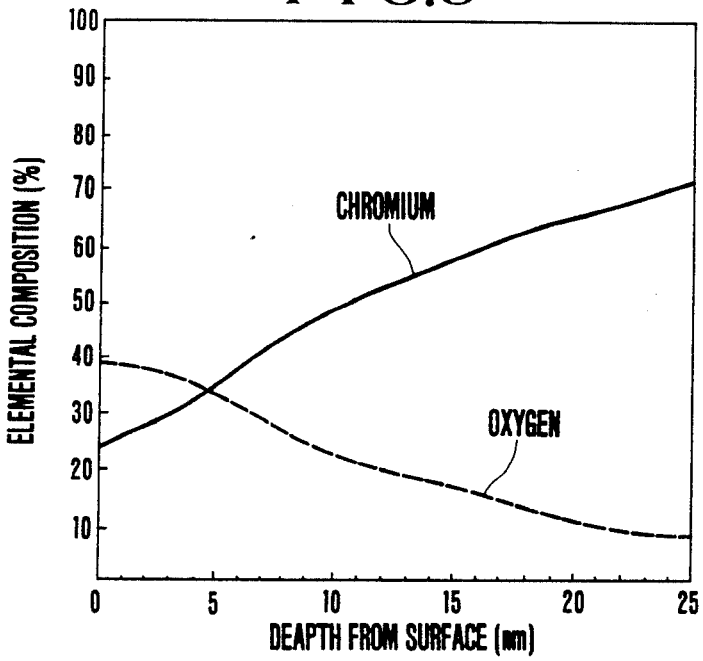
FIG. 8 is a graph showing the results of Auger local analysis (portion of protuberant crystalline product)

On the support having the electrodeposited chromium layer prepared according to the method as described above, it was confirmed by electron microscope photographs (FIGS. 1 and 2) that there was formed a surface having plate crystals protruded and dispersed on the ground in shape of a mass of minute particles. Also, the electrodeposited chromium layer surface was analyzed of its composition by means of an Auger electron analyzer (scanning type Auger electron microscope PHI Model 595, produced by Perkin Elmer Corp.) to obtain the results of elemental analysis in the depth direction. FIG. 8 shows the results at the portion of protuberant crystals, and FIG. 9 those at the portion where no crystals exist.

Measuring conditions were; ion gun: 4 KeV, 25 mA, raster 5 mm×5 mm; argon ion employed; etching speed of 20 Å/min. with $Ta_2O_5$ as the standard; primary electron gun: 10 KeV; diameter of electron beam narrowed to about 500 A. During analysis of the portion of protuberant crystals, electron beam was irradiated on the center of the flat portion of the plate crystal as in FIGS. 1 and 2 so that the brim of the crystal portion might not be included within the region irradiated, the ion beam being irradiated at an incident angle of approximately 90° relative to the flat portion of the plate crystal, and the crystal to be measured were chosen so that the incident ion beam onto the spot to be analyzed might not be interfered with the surrounding other plate crystals. Before and after measurement, it was confirmed by the above scanning type electron microscope PHI Model 595 whether the plate crystal to be analyzed was correctly etched or not.

Figure 9:
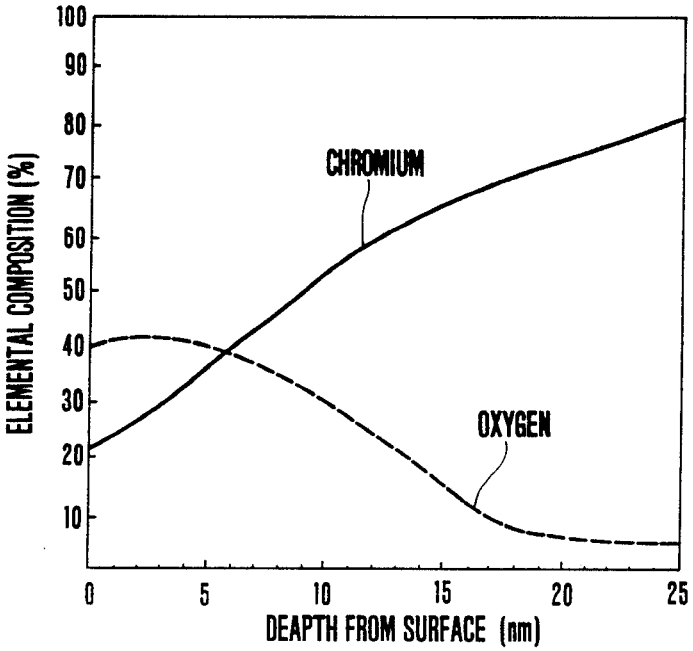
FIG. 9 is a graph showing the results of Auger local analysis (portion being free of crystalline product)

With regard to calculations of elemental compositions; the peak intensities of Auger spectrum (differential form) were those of the peak at 529 eV for chromium and the peak at 503 eV for oxygen, with the relative sensitivity of chromium being made 0.28 and that of oxygen 0.35. The depths from the surface on the axes of abscissa in FIGS. 8 and 9 are transformations of the etching time from said etching speed into depths, being calculated by regarding all the compositions as $Cr_2O_3$.

Figure 10:
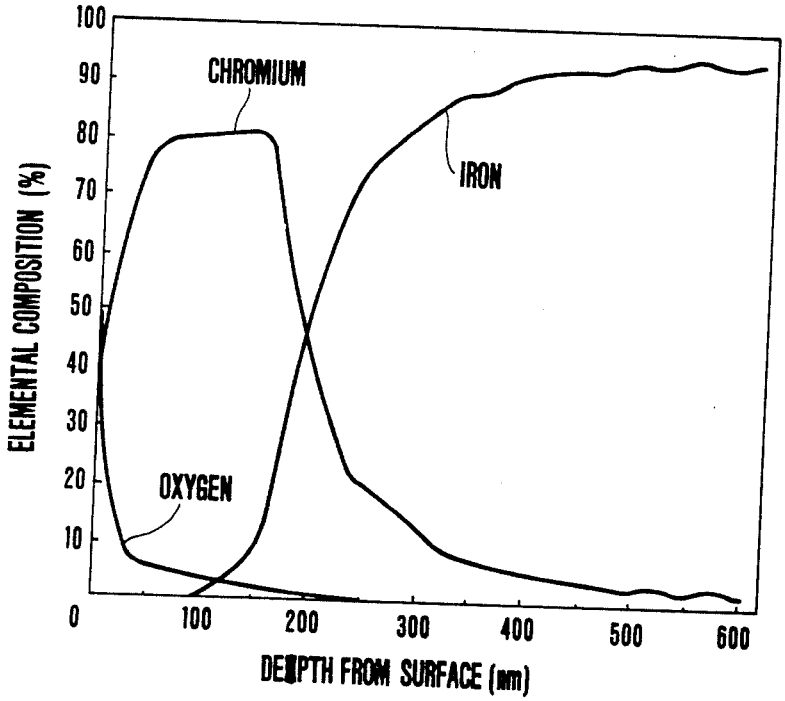
FIG. 10 is a graph showing the results of Auger local analysis.

Further, FIG. 10 shows the results of analysis obtained by etching to the substrate at the portion where no crystal protrudes. The measuring conditions were the same as above except that the etching speed was made 85 Å/min. ($Ta_2O_5$ as the standard). The axis of abscissa in FIG. 10 is the transformation of etching time into depth similarly as mentioned above, being calculated by regarding all the compositions as chromic oxide ($Cr_2O_3$). The crystal portion was also similarly subjected to etching to the substrate of iron, whereby the profile of elements in the depth direction was obtained similarly as in FIG. 10. From these results, it can be seen that the composition is constituted substantially of iron atoms and chromium atoms in the substrate side, with the composition being continuously varied such that the constitutional ratio of iron is greater and that of chromium atoms is smaller closer as to said substrate.

Next, on this support was coated a photosensitive coating solution having the following composition by a rotary coating machine, followed by drying at 100° C. for 4 minutes, to obtain a lithographic printing plate material.

[Photosensitive coating solution composition]

Esterified product of naphthoquinone-(1,2)-diazide-(2)-5-sulfonic acid chloride with m-cresol-formaldehyde novolac
resin (condensation degree: 25 mol %) . . . 3.5 g
m-Cresol-formaldehyde novolac resin . . . 8.0 g
Naphthoquinone-(1,2)-diazide-(2)-4-sulfonic acid chloride . . . 0.15 g
Esterified product of p-octylphenolformaldehyde novolac resin and naphthoquinone-(1,2)-diazide-(2)-5-sulfonic acid
chloride (condensation degree: 50 mol %) . . . 0.12 g
Oil blue #603 (produced by Orient Kagaku Co., Ltd.) . . . 0.2 g
Ethyl cellosolve . . . 100 g The weight of the coating after drying was about 2.7 g/$m^2$.

On the thus obtained lithographic printing plate material were closely contacted a positive-manuscript film and the Step Tablet for measurement of sensitivity (produced by Eastman Kodak Co., No. 2, 21 steps with density differences each of 0.15), and light exposure was applied by a 2 KW metal halide lamp (Idolfin 2000 produced by Iwasaki Denki Co., Ltd.) as the light source from a distance of 1 m for 80 seconds, followed by development with an aqueous 4% sodium metasilicate solution at 25° C. for 45 seconds to obtain a lithographic printing plate.

For examination of the adhesion between the support and the image portions and the printing life of the printing plate, a treating chemicals resistance test and a printing test were conducted. As the treating chemicals resistance test, durability to aqueous isopropyl alcohol solution used in Darlgrain damping water system was examined.

The printing plate having formed an image with density differences on the steps of the above gray scale was immersed in an aqueous 35% isopropyl alcohol solution at room temperature for 20 minutes and washed with water; and then the image portion was rubbed with a defatted cotton impregnated with water. By comparison of the resultant image portion with the image portion before immersing in isopropyl alcohol, the extent of corrosion to the chemical of the image portion was judged. As the result, the aforesaid printing plate was free from corrosion to exhibit good resistance to the treating chemicals. Printing resistance test was conducted by carrying out printing with the printing plate mounted on an offset printing machine (Hamadaster 900 CDX), and evaluated by the number of printed sheets obtained until there are formed damages on the image portion to make printing no longer possible. As the result, with the use of the aforesaid printing plate, good printing products were obtained up to 200,000 sheets.

COMPARATIVE EXAMPLE 1

A support for a lithographic printing plate having provided an electrodeposited chromium layer on a carbon steel was produced according to the method as described in European Patent Publication No. 020021. That is, the same kind of carbon steel plate as in Example 1 was immersed in a pre-washing tank (dil. hydrochloric acid) at 40° C. for 30 seconds, washed with water and then immersed in a grainer bath tank containing 60 g of ammonium hydrogen fluoride per one liter of water at 40° C. for 5 minutes, followed by washing with water. The resultant treated plate was immersed in a plating bath containing 250 g of chromic acid anhydride and 2 g of sulfuric acid per one liter of water, connected to the cathode and plating treatment was carried out at a bath temperature of 35° C., a current density of 110 A/dm$^2$ for 60 seconds. On the thus obtained steel plate support having an electrodeposited chromium layer on its surface was applied the coating in the same formulation as in Example 1 to obtain a lithographic printing plate material.

Light exposure and development were applied on such a lithographic printing plate material in the same manner as described in Example 1 to obtain a lithographic printing plate, which was in turn subjected to the same treating chemicals resistance test and printing test as in the above Example 1. As the result, this printing plate had poor resistance to the treating chemicals with corrosion being markedly observed at the image portion. Also, when about 50,000 sheets were printed, ink spreading occurred at dot portions and scumming at the non-image portion, which could not be repaired to make further printing impossible.

EXAMPLE 2

As the pre-treatment, a steel plate having a thickness of 0.1 mm was subjected to electrolytic treatment in the same manner as in Example 1.

The steel plate having thus finished the pre-treatment step was subjected to shower washing with water and the subsequent main treatment step was applied thereon. The composition of the Electrolyte II and the Electrolytic Conditions II in the main treatment step are shown in Table 9 and Table 10.

TABLE 9

| Electrolyte II | |
|---|---|
| Anhydrous chromic acid | 400 kg |
| Barium nitrate | 3.8 kg |
| Nitric acid (64%) | 1.2 lit. |
| Ammonium hydrogen fluoride | 5 kg |
| Acetic acid | 0.1 kg |
| Barium fluoride | 0.1 kg |
| Water | 1000 lit. |

TABLE 10

| Electrolysis Conditions II | |
|---|---|
| Current density | 10 A/dm$^2$ |
| Liquid temperature | 30° C. |
| Cathode | Iron plate for support (1.2 m$^2$) |
| Anode | Lead plate (1.2 m$^2$) |
| Treatment time | 5 min. |

The steel plate having thus finished the main treatment step was washed by showering with water and dried on air at room temperature.

It was confirmed by electron microscope photographs that there existed cubic crystals and agglomerated assemblages thereof scattered on the surface of the steel plate with electrodeposited chromium layer. An example of said photographs is shown in FIG. 6. Analysis of the thus formed electrodeposisted chromium layer surface was conducted by Auger electron analyzer similarly as in Example 1 to give element profiles in the depth direction similar to FIG. 8, whereby it was confirmed that the surface side portion had the same constitution of chromium and oxygen as in the support prepared in Example 1.

Next, on this support was coated a photosensitive coating solution having the composition shown below by use of a rotary coating machine, followed by drying at 85° C. for 3 minutes, to obtain a lithographic printing plate material.

[Photosensitive coating solution composition]

| | |
|---|---|
| Copolymer A | 5.0 g |
| Diazo resin B | 0.5 g |
| Jurymer-AC-10L (produced by Nippon Junyaku Co.) | 0.05 g |
| Aizen Victoria Pure Blue (produced by Hodogaya Kagaku Co.) | 0.1 g |
| Methyl cellosolve | 100 ml |

The above copolymer A was obtained by dissolving a composition in terms of molar ratio of p-hydroxyphenyl methacrylamide/acrylonitrile/ethyl acrylate/methacrylic acid = 10/30/60/6 and 1/400 mole of azobisisobutyronitrile to the above monomers in methyl cellosolve, heating the solution in a sealed tube replaced with nitrogen at 65° C. for 10 hours, and after completion of the reaction pouring the reaction mixture into water under stirring, followed by filtration and drying of the white precipitates formed. The diazo resin B is a hexafluorophosphoric acid salt obtained by mixing an aqueous 5% diazo resin (trade name: D-012 produced by E.H.C. Co.) and an aqueous 10% ammonium hexafluorophosphate, recovering the precipitates formed by suction filtration and drying the precipitates under reduced pressure at 30° to 40° C. The above copolymer had a weight average molecular weight of 80,000, and further the molecular weight distribution of the above resin was measured by gel permeation chromatography (GPC) to find that the fractions with molecular weights of trimer or lower comprise 93% of the total fractions.

The weight of the coating after drying was 2.0 g/m$^2$.

On the thus obtained lithographic printing plate material was closely contacted a negative manuscript film and light exposure was applied thereon at a distance of 1 m from a 2 KW metal halide lamp (Idolphin 2000, produced by Iwasaki Denki Co., Ltd.) as the light source, followed by development with a developer having the following composition, to obtain a lithographic printing plate.

[Composition of developer]

| | |
|---|---|
| Phenyl cellosolve | 160 g |
| Diethanolamine | 70 g |
| Pionin A-44B (produced by Takemoto Yushi Co., Ltd.) | 50 g |
| Water | 780 g |

The developing conditions were 25° C. and 45 seconds.

For examination of the adhesion between the support and the image portion, tolerance of developing methods and printing life of the printing plate, "hand processing" treatment, the treatment by means of an automatic developing machine and printing test were conducted.

Hand processing was carried out by impregnating a sponge sufficiently with the above developer, rubbing uniformly and lightly the surface of the above lithographic printing plate material having finished exposure with the sponge for 2 minutes, followed by washing with water. As the result, the above lithographic printing plate material was not damaged at the image portion at all both by the hand processing and by the developing machine. The printing test was performed similarly as in Example 1. As the result, the lithographic printing plate using the support of this invention gave good printed products up to 200,000 sheets.

COMPARATIVE EXAMPLE 2

Separately, the following sample was prepared for a comparative test. That is, there was prepared a plate material having provided an electrodeposited chromium layer in the same manner as in Comparative Example 1 on the same steel plate as used in Example 2, and on this steel plate support was coated and dried the same photosensitive coating solution as described in Example 2 to provide a lithographic printing plate material. Then, a lithographic printing plate was prepared from this material and printing life test was conducted. As the result, in the hand processing, the image portion was markedly damaged until it was almost peeled off. Further, in printing, a part of the image portion was peeled off when 80,000 sheets had been printed and printing was no longer possible.

EXAMPLE 3

As the pre-treatment an iron plate having a thickness of 0.15 mm, was subjected to the electrolytic treatment in the same manner as in Example 1.

The iron plate having finished the pre-treatment step was washed by showering with water and then subjected to the subsequent main treatment. The composition of the Electrolyte II and the Electrolysis Conditions II in the main treatment are shown in Table 11 and Table 12.

TABLE 11

| Electrolyte II | |
|---|---|
| Anhydrous chromic acid | 430 kg |
| Barium nitrate | 3.8 kg |
| Nitric acid (64%) | 1.2 lit. |
| Ammonium hydrofluoride | 5 kg |
| Acetic acid | 0.2 kg |
| Barium fluoride | 0.1 kg |
| Water | 1000 lit. |

TABLE 12

| Electrolysis Conditions II | |
|---|---|
| Current density | 20 A/dm$^2$ |
| Liquid temperature | 40° C. |
| Cathode | Iron plate for support (1.2 m$^2$) |
| Anode | Lead plate (1.6 m$^2$) |
| Treatment time | 5 min. |

The iron plate having thus finished the main treatment step was subsequently subjected to shower washing with water, and thereafter transferred to the post-treatment step. In the post-treat step, the plate was first immersed in an aqueous 5% caustic soda solution at 40° C. for one minute, followed by shower washing with water, and then immersed in an aqueous solution (1 wt. %) of potassium fluorozirconate at room temperature for about one minute, followed by shower washing with water. The iron plate having finished the post-treatment step was dried on cool air.

On the surface of the iron plate coated with the electrodeposited chromium layer prepared according to the method as described above, there are formed crystals in shape of an agglomerated assemblages comprising cubic crystals as constituent elements. The electrodeposited chromium layer surface thus formed was analyzed by Auger electron analyzer similarly as in Example 1 to obtain an elemental profile in the depth direction similar to FIG. 8, and it was confirmed that the constitution of chromium and oxygen in the surface side portion was similar to that of the support prepared in Example 1.

Next, on this iron plate was coated a photosensitive coating solution having the following composition, followed by drying at 100° C. for 4 minutes, to provide a lithographic printing plate material.

[Composition of photosensitive coating solution]

Condensed product of naphthoquinone-(1,2)-diazide-(2)-5-sulfonic acid chloride and resorcinol-benzaldehyde novolak resin (synthesized according to the method as described in Example 1 in Japanese Unexamined Patent Publication No. 1044/1981) . . . 3.5 g Co-condensed novolak resin of phenol, m-, p-cresol mixture and formaldehyde (molar ratio of phenol to cresol: 3:7, weight average molecular weight: 1500) . . . 8 g Naphthoquinone-(1,2)-diazide-(2)-4-sulfonic acid chloride . . . 0.15 g Oil Blue #603 (produced by Orient Kagaku Kogyo Co., Ltd.) . . . 0.2 g p-t-butylphenol-formaldehyde novolak resin . . . 0.15 g Methyl cellosolve . . . 100 g The weight of the coating after drying was about 2.5 g/m$^2$.

On the thus obtained lithographic printing plate material were closely contacted Step Tablet for measurement of sensitivity (produced by Eastman Kodak Co., No. 2, 21 steps with individual density differences of 0.15) and a posi manuscript film, and light exposure was applied by a 2 KW metal halide lamp (Idolfin 2000 produced by Iwasaki Denki Co., Ltd.) as the light source from a distance of 1 m for 80 seconds, followed by development with an aqueous 4% sodium metasilicate solution at 25° C. for 45 seconds to obtain a lithographic printing plate.

For examination of the adhesion between the support and the image portions and the printing life of the printing plate, a treating chemicals resistance test and a printing test were conducted. As the treating chemicals resistance test, the durability to Ultra-plate Cleaner (produced by A.B. Chemical Co.) which is used as the washing liquid for removal of the scumming generated at the non-image portion during printing was examined.

The printing plate having formed an image with density differences on the steps of the above gray scale was immersed in the stock solution of Ultra Plate Cleaner at room temperature for 20 minutes and washed with water. By comparison of the resultant image portion with the image portion before immersion, the extent of corrosion to the chemicals of the image portion was judged. As the result, the aforesaid printing plate was free from corrosion and also, with respect to the dots, the dots of an area percentage of 2% were maintained, thus exhibiting good resistance to the treating chemicals. The printing life test was conducted similarly as in Example 1. As the result, with the use of the aforesaid printing plate, good printing products were obtained up to 250,000 sheets. This printing plate had good water retentivity and printing could easily be managed.

COMPARATIVE EXAMPLE 3

Separately, the following sample was prepared for comparative purpose. That is, there was prepared a plate material having provided an electrodeposited chromium layer in the same manner as in Comparative Example 1 on the same iron plate as used in Example 3, and on this iron plate support was coated and dried the same photosensitive coating solution as described in Example 3 to provide a lithographic printing plate material. Then, a lithographic printing plate was prepared from this material similarly as in Example 3, and the treating chemicals resistance test and printing life test were conducted. As the result, the treating chemicals resistance was poor with the image portion being substantially lost with Ultra Plate Cleaner and all the dots were last even to the area percentage of 5% lost. On the other hand, in printing, a part of the image portion was peeled off when 60,000 sheets had been printed and printing was no longer possible.

EXAMPLE 4

The following composition was dispersed and homogenized in a ball mill at normal temperature for 48 hours:

| | |
|---|---|
| Zinc oxide | 95 parts by weight |
| Methylsilicone resin (50% solution in toluene) | 80 parts by weight |
| Toluene | 100 parts by weight |
| Ethyl alcohol | 25 parts by weight |

The obtained coating composition was applied onto the support used in Example 1 to a thickness of 10μ after drying. The thus formed printing plate material was then negatively charged using corona discharge equipment, and exposed imagewise to a light source consisting of ten 20 W fluorescent lamps through a lens system by use of a reflection positive original. The electrostatic latent image thus formed was then toner-developed using a polystyrene-based toner and by the magnet brush process. The resulting toner image was then fixed with heat, and subjected to hydrophilicity-imparting treatment to form a printing plate. When used for printing with an offset press, this printing plate yielded 300,000 satisfactory prints having a sharp image.

EXAMPLE 5

The following composition was dispersed and homoginized in a ball mill at normal temperature for 48 hours.

| | |
|---|---|
| Zinc oxide | 1 part by weight |
| m-Cresol-formaldehyde-novolak resin | 2 parts by weight |
| Rose Bengale | 0.01 part by weight |
| Methyl ethyl ketone | 1 part by weight |

The obtained coating composition was applied onto the support used in Example 2 to a thickness of 5μ after drying. After being charged, exposed, toner-developed and fixed with heat as described in Example 4, this plate was dipped in an aqueous alkali solution containing sodium silicate and sodium hydroxide to dissolve and remove the photoconductive layer in the non-image area (where the toner is not attached). When used for printing with an offset press, the thus obtained printing plate yielded 300,000 satisfactory prints having a sharp image.

EXAMPLE 6

| | |
|---|---|
| ε-Type copper phthalocyanine | 1 part by weight |
| m-Cresol phenol formaldehyde novolak resin | 6 parts by weight |
| Ethylene glycol monoethyl ether | 24 parts by weight |

The above composition was dispersed with ultrasonic dispersing equipment at normal temperature for 5 minutes, and used to make a printing plate material as described in Example 5. The plate material was then treated in the same way as in Example 5 to form a printing plate. The printing life of this printing plate was 300,000 prints or more.

EXAMPLE 7

The printing plate material obtained in Example 6 was positively charged using corona discharge equipment. An image was photographed at an enlarging factor of 16 (area ratio) by use of a micro film original and a commercially available photographic enlarger, and then developed using a + liquid developer. This was followed by the same treatment as that described in Example 5 to obtain a printing plate exhibiting a sharp image.

EXAMPLE 8

The printing plate material obtained in Example 6 was treated to form a printing plate in the same way as described in Example 7, except that a He-Ne laser was used as the light source. In this way, a printing plate exhibiting a sharp image was obtained.

EXAMPLE 9

The following coating composition was applied on the support used in Example 1 to a thickness of 3μ after drying to obtain a printing plate material comprising the support having a polymeric layer thereon.

| | |
|---|---|
| Epoxy Resin | 10 parts by weight |
| Victoria Pure Blue 30H | 0.1 parts by weight |
| Ethylcellosolve | 90 parts by weight |

A photosensitive material using zinc oxide on the market was negatively charged using corona discharge equipment, and exposed imagewise to a light source consisting of ten 20 W fluorescent lamps through a lens system by use of a reflection positive original. The electrostatic latent image thus formed was then toner-developed using a polystyrene-based toner and by the magnet brush process. The resulting toner image was then transferred onto the polymeric layer.

The toner-image on the polymeric layer was fixed with heat. The polymeric layer in non-image area was removed with methylcellosolve.

Printing plate thus obtained was used for printing with an offset press and this printing plate yielded 200,000 satisfactory prints having a sharp image.

EXAMPLE 10

A colloid solution prepared as described below was uniformly applied as a physical development nucleus onto the support made as described in Example 1, and dried to prepare a printing plate material.

Preparation of physical development nucleus:

| | | |
|---|---|---|
| Liquid A: | Palladium chloride | 2 g |
| | Hydrochloric acid | 35 ml |
| | Made up to 500 ml with water. | |
| Liquid B: | $Na_2S$ | 4 g |
| | 10% saponin | 30 ml |
| | Made up to 500 ml with water. | |
| Liquid C: | 15% of copolymer of methyl vinyl ether and maleic anhydride | 50 ml |
| | Gelatin | 30 g |
| | Made up to 500 ml with water. | |

Liquids A and B were mixed with violent stirring at room temperature, after addition of liquid C stirred for 5 minutes, and cooled to prepare a palladium sulfide physical development nucleus. Appropriate amounts of saponin as a surface active agent and formalin as hardening agent were then added, respectively, and the obtained mixture was applied onto the support to a wet thickness of 30μ.

On the other hand, a photosensitive material was prepared by applying a high contrast silver chloride bromide emulsion, which was prepared according to a usual procedure, onto a photographic polyester film, followed by drying. The thus prepared photosensitive material was then used to photograph a positive original by use of a process camera. The photosensitive element exposed in this way was then contacted to the physical development nucleus layer, and developed for 60 seconds by use of the developing solution having the following composition:

Developing solution:

-continued

| | |
|---|---|
| Phenidone | 1.0 g |
| Anhydrous sodium sulfite | 50 g |
| Hydroquinone | 12 g |
| Sodium hydroxide | 15 g |
| Sodium thiosulfate | 5 g |
| Made up to 1 liter with water. | |

When the photosensitive material was separated from the physical development nucleus layer a clear mirror surface-like positive image was obtained on the printing plate having the physical development nucleus layer. The thus obtained plate was then wiped with a 5% methanolic solution of 1-p-ethoxyphenyl-5-mercaptotetrazole as an agent for imparting ink receptivity. When the thus treated plate was then used immediately for printing by use of a printing ink, 50,000 satisfactory prints were obtained.

EXAMPLE 11

A negative printing plate material was made by the diffusion-transfer process as described below by using the support obtained in the same way as in Example 2.

(a) Preparation of photosensitive silver halide emulsion:

A silver iodide bromide emulsion (silver iodide: 5 mol %) was prepared from silver nitrate, potassium bromide and potassium iodide. The emulsion was then chemically sensitized by the gold-sulfur sensitizer. Then, 0.3 g of 4-hydroxy-6-methyl-1,3,3a,7-tetrazaindene per mol of silver halide was added as a stabilizer to the chemically sensitized emulsion to prepare a silver iodide bromide emulsion having a moderate sensitivity.

(b) Preparation of easily-soluble metal salt particles:

A pure silver chloride emulsion was prepared from silver nitrate and sodium chloride, and cleaned by sedimentation. Then, 0.6 g of 1-phenyl-5-mercaptotetrazole per mol of silver chloride was added to the emulsion to make it sparingly soluble.

The previously prepared photosensitive silver halide emulsion (a) was mixed with the thus prepared sparingly-soluble pure silver chloride emulsion (b). After adding an appropriate amount of saponin as a surface active agent to the obtained mixture, the mixture was applied onto the aforesaid physical development nucleus layer used in Example 10 to prepare a printing plate material.

Both emulsions (a) and (b) were mixed together in a proportion of 0.2 mol of silver iodide bromide emulsion per mol of silver chloride emulsion on the basis of silver.

A negative original film was brought into close contact with the silver halide emulsion layer, exposed and developed with a developing solution having the composition described below at a temperature of 30° C. for 90 seconds. Then, the printing plate material was dipped in running water at a temperature of 20° C. for 30 seconds to remove the upper silver halide layer.

[Composition of developing solution]:

| | |
|---|---|
| Hydroquinone | 12.0 g |
| Anhydrous sodium sulfite | 50.0 g |
| Phenidone | 1.2 g |
| Potassium hydroxide | 11.0 g |
| Sodium thiosulfate | 3.5 g |
| Anhydrous sodium sulfate | 50.0 g |
| Potassium bromide | 1.0 g |
| 1-Phenyl-5-mercaptotetrazole | 0.01 g |
| Made up to 1 liter with water. | |

The obtained printing plate was treated to impart ink receptivity as described in Example 10, and then immediately used for printing with an ink. The results were as shown below.

| Prints before stains disappear | Printing life |
|---|---|
| 8 | More than 25,000 prints |

(The printing press used was TOKO Model 810. The values in the "prints before stains disappear" column were determined by supplying an excess of the ink so that the whole surface of the printing plate was inked, stopping to supply the ink, and printing until the stains disappeared).

The results set forth in the above table clearly show that the printing plate using the support of this invention exhibits excellent water holding property and high printing life.

EXAMPLE 12

The photopolymerizable composition having the composition described below was whirl-coated onto the support obtained in accordance with Example 1, and dried at a temperature of 50° C. for 10 minutes. The silicone layer had a thickness of 6μ in dry state.

| | |
|---|---|
| Co-condensation product of acryloxypropyltrichlorosilane and α,ω-dihydroxydimethyl organopolysiloxane (compound exemplified in Japanese Unexamined Patent Publication No. 47997/1973) | 100 parts by weight |
| 4-Dimethylamino-4'-trimethylsilylbenzophenone | 5 parts by weight |
| Toluene | 1000 parts by weight |

Thereafter, a positive transparent original was brought into close contact with the thus coated support in a vacuum, and exposed to 2 kW Idle Fin at a distance of 1 m for 90 seconds. It was then developed with a developing solution comprising 100 parts of toluene and 150 parts of cyclohexane. Thus a printing plate in which the unexposed area was dissolved and removed was obtained.

The thus obtained printing plate was set on an offset press (Komori Sprint L-25B) and use for printing by using the coated paper, a dry offset color printing ink (BOWERS available from Printing Ink Company) and by removing the damping water feeder. Thus 150,000 high-quality prints were obtained.

COMPARATIVE EXAMPLE 4

A printing plate material was made in the same way as described in Example 12, except that an electrochemically grained and anodized aluminium plate was used instead of the support in Example 1. When this printing plate was used for printing in the same manner as Example 12, the silicone rubber at the non-image area peeled off from the substrate and caused the surface of the support to be scumed after 50,000 prints were produced.

EXAMPLE 13

The photosensitive solution having the composition described below was wire bar coated onto the support obtained in accordance with the procedure described in Example 2, and dried at a temperature of 100° C. for 3 minutes.

| | |
|---|---|
| Co-condensation product of bisphenol A, propylene oxide and maleic anhydride (Polylight TDR-1131R available from Dainippon Ink And Chemicals, Incorporated in Japan) | 40 parts by weight |
| Addition product of 4 moles of glycidyl methacrylate and 1 mole of xylylene diamine | 55 parts by weight |
| Benzoin methyl ether | 5 parts by weight |
| Cellosolve acetate | 700 parts by weight |

The thickness of the obtained layer was 8μ. Then, the silicone rubber solution set forth below was wire bar coated onto the thus obtained photosensitive layer, and dried at a temperature of 50° C. for 3 minutes.

| | |
|---|---|
| Silicone Rubber YE-3085 (50% solution, avilable from Toshiba Silicone K. K. in Japan) | 12 parts by weight |
| Benzoin isopropyl ether | 0.3 parts by weight |
| n-Heptane | 88 parts by weight |

The thickness of the obtained silicone rubber layer was 2μ. The surface of the thus formed silicone rubber layer was laminated with a 6μ-thick polyethylene terephthalate film (Lumilar available from Toray Industries Inc. in Japan) to obtain a photosensitive lithographic printing plate material.

Thereafter, a positive film was brought into close contact with the obtained printing plate material in a vacuum, and exposed to a 2 kW Idle Fin lamp at a distance of 1 m for 60 seconds. The Lumilar film was then peeled off, and the plate was developed in a n-heptane solution to give a lithographic printing plate. When used for printing under the same printing conditions as in Example 12, this printing plate yielded 170,000 high-quality prints.

EXAMPLE 14

A support was made according to the procedure in Example 1. The obtained support was set at the printing section of the automatic proof machine KF-122-E available from Dainippon Screen Mfg. Co., Ltd. An original plate, which was made by exposing through a 150-line dot image original on the Sakura PS off-set plate SMP (available from Konishiroku Photo Industry Co., Ltd.), developed and processed, was used. In this way, the image was transferred to the support by printing. The transfer ink was an ultraviolet-curing ink (Dye Cure available from Dainippon Ink And Chemicals, Incorporated). After the transfer, the support was subjected to the exposure curing treatment by use of a 2 kW high-pressure mercury vapor lamp at a distance of 60 cm to obtain a duplicate printing plate.

When used for producing 30,000 prints with a roll-fed offset printing press, the thus obtained duplicate printing plate yielded satisfactory prints which exhibited a good image and sharply reproduced the 2% dot of the original plate. Even when the amount of wetting water was reduced during printing, defects such as scumming and ink spreading at dot portion did not occur. Further, the quality of the print at the end of printing was almost the same as that obtained at the beginning of printing.

Examination after printing of the gripped section of the printing plate revealed that the section did not damaged due to gripping and there was no risk of gripping failure.

COMPARATIVE EXAMPLE 5

A duplicate printing plate was made in the same way as described in Example 14, except that a conventional chromium-plated iron plate (Tin Free available from Nippon Steel Corporation) was used instead of the support of this invention.

Since this chromium-plated iron plate was not sufficiently clean, it was degreased in advance in an aqueous 5% sodium metasilicate solution at a temperature of 40° C. for 4 minutes, followed by washing with water and drying. The iron plate was then dipped in an aqueous potassium permanganate solution at room temperature for 1 minute and then in an aqueous 1% oxalic acid solution at room temperature for 1 minute, followed by washing with water and drying. In this way, the iron plate was cleaned, activated and then used for making the duplicate printing plate.

Up to the step for making the duplicate printing plate, no significant difference was observed compared with Example 14. However, in the printing by use of this printing plate, the non-image area was scummed immediately after the printing was started, because of insufficient hydrophilicity and water receptive ability of the printing plate. In addition, after about 1,500 prints were produced, the image area was damaged and ink receptivity deteriorated so that normal prints could not be obtained any more.

We claim:

1. A support for lithographic printing plate having an electrodeposited chromium layer on an iron material, characterized in that the surface of said electrodeposited layer has a shape in which crystalline products with angles protrude thereon, the elemental composition in the surface side portion of said electrodeposited layer consists substantially of chromium and oxygen and the ratio of the atomic concentration of chromium and oxygen at said portion is substantially even at the same depth from every point on said surface.

2. The support for lithographic printing plate according to claim 1, wherein, in variations of the atomic concentration of chromium and oxygen in the depth direction along the normal line on the electrodeposited chromium layer surface, the atomic concentration Ya % of chromium at the depth of Xnm from said surface is within the range as represented by the formula $Ya \leqq -0.464X^2+7.82X+70$ (where $0 \leqq X \leqq 6$) and the formula $Ya \geqq -0.0398X^2+1.99X+15$ (where $0 \leqq X \leqq 25$), and the atomic concentration Yb % of oxygen within the range represented by the formula $Yb \leqq 0.0884X^2-4.46X+80$ (where $0 \leqq X \leqq 25$) and the formula $Yb \geqq 0.5X^2-8.1X+20$ (where $0 \leqq X \leqq 3$).

3. The support for lithographic printing plate according to claim 2, wherein $Ya+Yb \geqq -0.0187X^2+1.23X+50$ (where $0 \leqq X \leqq 25$).

4. The support for lithographic printing plate according to claim 2, wherein $Yb > Ya$ at $X < 1.0$, and the depth Xonm when $Ya = yb$ is within the range $1.0 \leqq Xo \leqq 14.0$.

5. The support for lithographic printing plate according to claim 3, wherein $Yb > Ya$ at $X < 1.0$, and the depth Xonm when $Ya = Yb$ is within the range $1.0 \leqq Xo \leqq 14.0$.

6. The support for lithographic printing plate according to claim 1, wherein the portion of the protuberant crystalline products is at least 20% in terms of the orthographic projection area.

7. The support for lithographic printing plate according to claim 1, wherein the surface shape in which said crystalline products protrude is a shape in which at least one of exposed plate or cubic crystals, an agglomerated product of said crystals or a mixture of said crystals, and said agglomerated product protrude.

8. The support for lithographic printing plate according to claim 7, wherein said plate crystals have diameters of 0.5 to 5 μm and thicknesses of 0.01 to 0.8 μm.

9. The support for lithographic printing plate according to claim 7, wherein said cubic crystals have side lengths of 0.1 to 2 μm.

* * * * *